US011456539B2

(12) United States Patent
Liu et al.

(10) Patent No.: US 11,456,539 B2
(45) Date of Patent: Sep. 27, 2022

(54) ABSORBING METAMATERIAL

(71) Applicant: KUANG-CHI CUTTING EDGE TECHNOLOGY LTD., Shenzhen (CN)

(72) Inventors: Ruopeng Liu, Shenzhen (CN); Zhiya Zhao, Shenzhen (CN); Kangqiang Chen, Shenzhen (CN); Sucheng Li, Shenzhen (CN)

(73) Assignee: KUANG-CHI CUTTING EDGE TECHNOLOGY LTD., Shenzhen (CN)

( * ) Notice: Subject to any disclaimer, the term of this patent is extended or adjusted under 35 U.S.C. 154(b) by 96 days.

(21) Appl. No.: 17/159,384

(22) Filed: Jan. 27, 2021

(65) Prior Publication Data

US 2021/0151897 A1 May 20, 2021

Related U.S. Application Data

(63) Continuation of application No. PCT/CN2018/125125, filed on Dec. 29, 2018.

(30) Foreign Application Priority Data

Jul. 27, 2018 (CN) ..... 201810843911.9
Jul. 27, 2018 (CN) ..... 201821204494.5

(51) Int. Cl.
*H01Q 17/00* (2006.01)
*H01Q 1/42* (2006.01)

(52) U.S. Cl.
CPC ..... *H01Q 17/007* (2013.01); *H01Q 1/422* (2013.01)

(58) Field of Classification Search
CPC .... H01Q 17/007; H01Q 17/008; H01Q 1/422; H01Q 1/405; H01Q 15/0086
See application file for complete search history.

(56) References Cited

U.S. PATENT DOCUMENTS 6,756,932 B1 * 6/2004 Barker ..... H01Q 17/00 342/1
2013/0314765 A1 * 11/2013 Padilla ..... G01K 7/003 359/315
2021/0151897 A1 * 5/2021 Liu ..... H01Q 1/422

FOREIGN PATENT DOCUMENTS

CN 102480909 A * 5/2012
CN 102480909 A 5/2012
CN 102798901 A * 11/2012 ..... B82Y 20/00
CN 103233206 A * 8/2013
CN 105514619 A 4/2016
CN 105977632 A * 9/2016
(Continued)

OTHER PUBLICATIONS

International Search Report for corresponding PCT PCT/CN2018/125125, dated Apr. 19, 2019, 2 pages.

*Primary Examiner* — Seokjin Kim
(74) *Attorney, Agent, or Firm* — Armstrong Teasdale LLP

(57) ABSTRACT

The disclosure discloses an absorbing metamaterial, including a plurality of metamaterial units that are periodically arranged, where the metamaterial unit includes: a first loop disposed on a first plane; and a second loop disposed on a second plane, where the first plane is perpendicular to the second plane, so that the first loop and the second loop are orthogonal. According to the foregoing technical solution in the disclosure, wave absorption in a large angle range can be implemented while ensuring wideband wave absorption.

9 Claims, 5 Drawing Sheets

(56) References Cited

FOREIGN PATENT DOCUMENTS

| | | | | | |
|---|---|---|---|---|---|
| CN | 105977632 | A | | 9/2016 | |
| CN | 109193174 | A | * | 1/2019 | |
| EP | 3557695 | A1 | * | 10/2019 | ..... H01Q 15/0086 |
| JP | 2020034285 | A | * | 3/2020 | |
| KR | 20120048892 | A | * | 5/2012 | ..... G02B 1/002 |
| KR | 20170112935 | A | * | 10/2017 | ..... H01G 5/38 |
| WO | WO-2017164523 | A1 | * | 9/2017 | ..... H01L 41/22 |
| WO | WO-2020019674 | A1 | * | 1/2020 | ..... H01Q 1/422 |

* cited by examiner

ABSORBING METAMATERIAL

CROSS-REFERENCE TO RELATED APPLICATIONS

The present application is a continuation of International Patent Application No. PCT/CN2018/125125, filed Dec. 29, 2018, which claims the priority of Chinese Patent Application No. 201810843911.9, filed Jul. 27, 2018, and Chinese Patent Application No. 201821204494.5, filed Jul. 27, 2018, which are herein incorporated by reference in their entirety.

TECHNICAL FIELD

The disclosure relates to the field of metamaterial technologies, and specifically, to an absorbing metamaterial.

BACKGROUND

With continuous development of modern communications technologies, electromagnetic spectrum resources become increasingly insufficient. Meanwhile, widespread electromagnetic waves also become the fourth largest public hazard, that is, electromagnetic pollution, that endangers human existence. An effective means to implement electromagnetic compatibility and control electromagnetic pollution is using a wave-absorbing material. Using a wave-absorbing material to absorb electromagnetic waves in a specific frequency band can prevent external electromagnetic waves from interfering with normal operating of a radio device, and can also reduce electromagnetic waves existing in free space.

Currently, in a common wideband wave-absorbing material structure, wideband wave absorption is implemented through cascading and superposition of multi-layer two-dimensional structures. This structure can implement wideband wave absorption. However, the structure is complex, and impedance matching between the multi-layer structures is difficult. Therefore, once an incident angle changes, a wave-absorbing effect also greatly changes. In addition, because the multi-layer two-dimensional structures are superposed, a wave-transparent capability of this structure is relatively poor, and high wave-transparency can be implemented only in a very narrow frequency band.

SUMMARY

For the problems in the related art, the disclosure provides an absorbing metamaterial, to implement wave absorption in a large angle range while ensuring wideband wave absorption.

The technical solutions in the disclosure are implemented as follows:

According to an embodiment of the disclosure, an absorbing metamaterial is provided, including a plurality of metamaterial units that are periodically arranged, where the metamaterial unit includes:

a first loop disposed on a first plane; and a second loop disposed on a second plane, where the first plane is perpendicular to the second plane, so that the first loop and the second loop are orthogonal.

According to an embodiment of the disclosure, the metamaterial unit further includes a first dielectric substrate and a second dielectric substrate that are perpendicular to each other, and the first loop and the second loop are disposed on the first dielectric substrate and the second dielectric substrate respectively.

According to an embodiment of the disclosure, each of the first loop and the second loop includes: two metal semi-rings that are spaced from each other and whose openings are opposite to each other; and two resistors, where two ends of each resistor are respectively connected to two ends that are of the two metal semi-rings and that are located on a same side and opposite to each other.

According to an embodiment of the disclosure, a metal extension part is further disposed between two ends of each resistor and an end of a corresponding metal semi-ring.

According to an embodiment of the disclosure, one resistor in the first loop is located between two opposite metal semi-rings in the second loop, and the other resistor in the first loop is located outside the two opposite metal semi-rings in the second loop.

According to an embodiment of the disclosure, resistances of the two resistors in each of the first loop and the second loop are different.

According to an embodiment of the disclosure, a size of two metal semi-rings in the first loop is the same as a size of two metal semi-rings in the second loop.

According to an embodiment of the disclosure, electrolytes are filled between adjacent first dielectric substrates and between adjacent second dielectric substrates.

According to an embodiment of the disclosure, the absorbing metamaterial further includes a metal backplane perpendicular to the first plane and perpendicular to the second plane, where the plurality of metamaterial units are periodically arranged on a side surface of the metal backplane.

According to an embodiment of the disclosure, the absorbing metamaterial further includes a skin, where the plurality of metamaterial units are periodically arranged on a side surface of the skin.

The foregoing technical solution of the disclosure is based on a metamaterial in a three-dimensional structure, the structure is simple and clear, and impedance matching is easily implemented. In addition, parameters and positions of the first loop and the second loop can be properly adjusted, to implement wave absorption in a large angle range while ensuring wideband wave absorption.

BRIEF DESCRIPTION OF DRAWINGS

To describe the technical solutions in the embodiments of the disclosure or in the related art more clearly, the following briefly describes the accompanying drawings required for describing the embodiments. Apparently, the accompanying drawings in the following description show merely some embodiments of the disclosure, and a person of ordinary skill in the art may still derive other drawings from these accompanying drawings without creative efforts.

DESCRIPTION OF EMBODIMENTS

The following clearly and completely describes the technical solutions in the embodiments of the disclosure with reference to the accompanying drawings in the embodiments of the disclosure. Apparently, the described embodiments are merely some but not all of the embodiments of the disclosure. All other embodiments obtained by a person of ordinary skill in the art based on the embodiments of the disclosure shall fall within the protection scope of the disclosure.

It should be understood that, indicated orientation or position relationships are orientation or position relationships based on the accompanying drawings, are merely intended to describe this application and simplify descriptions, but not to indicate or imply that indicated apparatuses or elements need to have a specific orientation or need to be constructed or operated in a specific orientation, and therefore should not be construed as a limitation on this application. In addition, a feature limited by "first" or "second" may explicitly or implicitly include one or more of the feature. In the descriptions of this application, "a plurality of" means two or more, unless otherwise specified.

Figure 1:
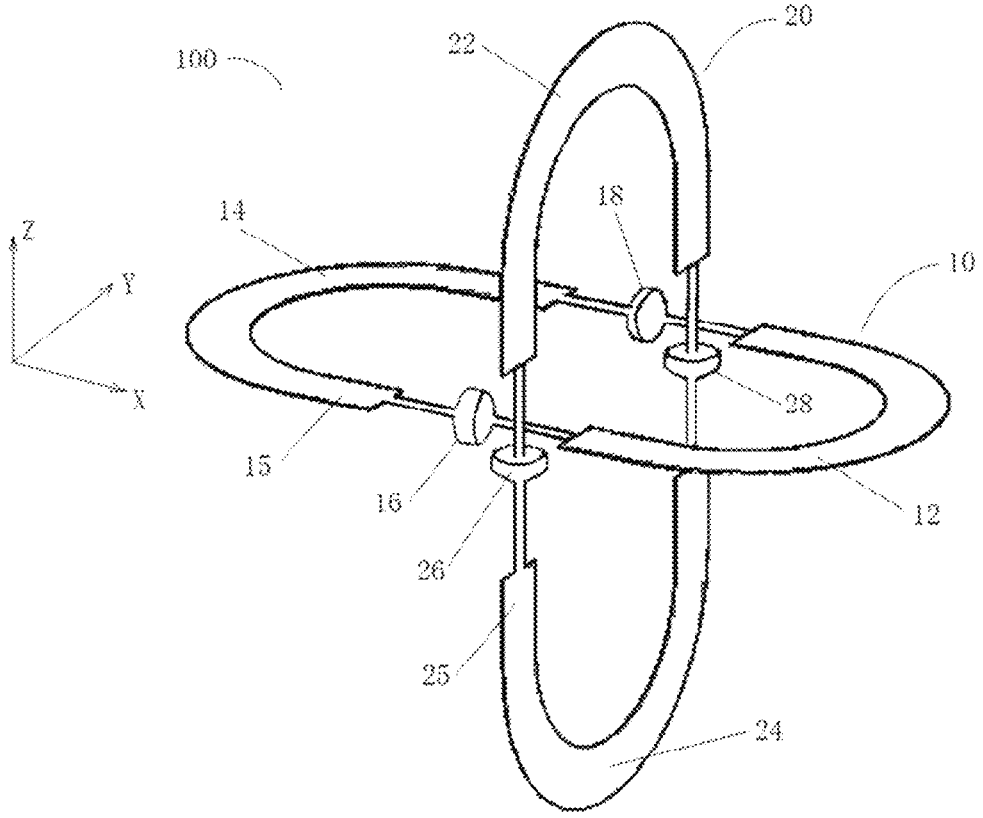
FIG. 1 is a schematic diagram of orthogonal loops of an absorbing metamaterial according to an embodiment of the disclosure.
Figure 2:
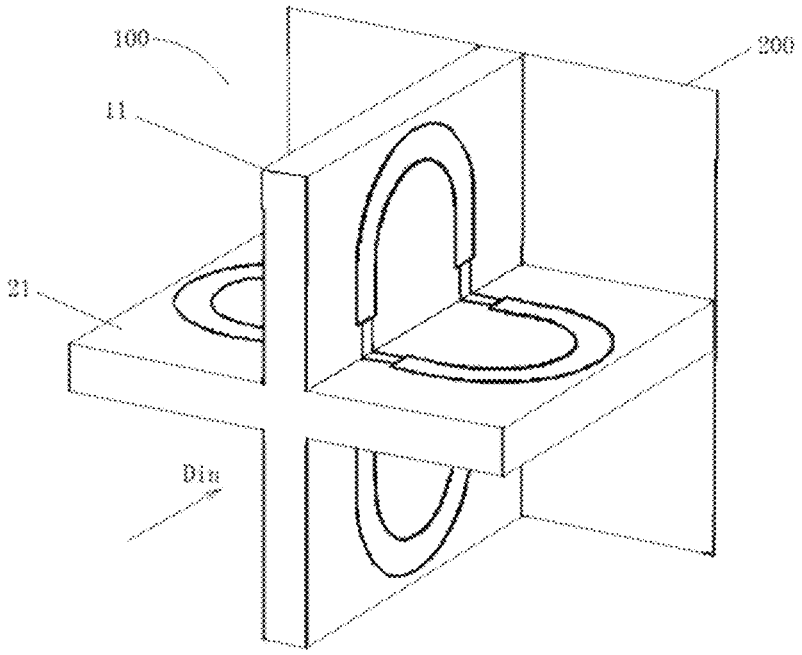
FIG. 2 is a schematic diagram of an absorbing metamaterial according to an embodiment of the disclosure.

With reference to FIG. 1 and FIG. 2, the disclosure provides an absorbing metamaterial. The absorbing metamaterial includes a plurality of metamaterial units 100 that are periodically arranged. The metamaterial unit 100 includes: a first loop 10 disposed on a first plane; and a second loop 20 disposed on a second plane, where the first plane is perpendicular to the second plane, so that the first loop 10 and the second loop 20 are orthogonal. It should be understood that, in FIG. 1, the first plane is an XY plane, and the second plane is a YZ plane. In addition, FIG. 1 and FIG. 2 show merely one metamaterial unit 100, but it does not mean that the absorbing metamaterial in the disclosure includes only one metamaterial unit. A specific quantity of metamaterial units may be determined based on a specific application scenario.

The foregoing technical solution of the disclosure is based on a metamaterial in a three-dimensional structure, the structure is simple and clear, and impedance matching is easily implemented. In addition, parameters and positions of the first loop 10 and the second loop 20 can be properly adjusted, to implement wave absorption in a large angle range while ensuring wideband wave absorption.

Referring to FIG. 1, the first loop 10 includes: two metal semi-rings 12 and 14, and two resistors 16 and 18. The two metal semi-rings 12 and 14 are spaced from each other, and their openings are opposite to each other. The resistors 16 and 18 each is connected to the two metal semi-rings 12 and 14 whose openings are opposite to each other. Specifically, two ends of the resistor 16 are respectively connected to two ends that are of the two metal semi-rings 12 and 14 and that are located on a same side and opposite to each other, and two ends of the resistor 18 are respectively connected to two ends that are of the two metal semi-rings 12 and 14 and that are located on the other side and opposite to each other. The two metal semi-rings 12 and 14 together form a shape of a runway on sports ground, that is, ends that are of two parallel lines and that are on a same side each is connected to a semicircle, and each metal semi-ring (12 or 14) includes a semicircle and half of the two parallel lines. Likewise, the second loop 20 includes: two metal semi-rings 22 and 24, and two resistors 26 and 28. The two metal semi-rings 22 and 24 are spaced from each other, and their openings are opposite to each other. The resistors 26 and 28 each is connected to the two metal semi-rings 22 and 24 whose openings are opposite to each other. Specifically, two ends of the resistor 26 are respectively connected to two ends that are of the two metal semi-rings 22 and 24 and that are located on a same side and opposite to each other, and two ends of the resistor 28 are respectively connected to two ends that are of the two metal semi-rings 22 and 24 and that are located on the other side and opposite to each other. The two metal semi-rings 22 and 24 together form a shape of a runway on sports ground, that is, ends that are of two parallel lines and that are on a same side each is connected to a semicircle, and each metal semi-ring (22 or 24) includes a semicircle and half of the two parallel lines. In this way, two resistors are used to connect two metal semi-rings on a same plane in series, to separately form the first loop and the second loop. In addition, the first loop 10 and the second loop 20 that are orthogonal to each other enable the absorbing metamaterial in the disclosure to have relatively good wave-absorbing performance in dual-polarization. Moreover, because such a three-dimensional structure is used, a metal duty cycle in an incident direction Din of electromagnetic waves (as shown in FIG. 2) is low. Therefore, impedance matching is more easily implemented.

Further referring to FIG. 1, in the first loop 10, a metal extension part 15 is further disposed between two ends of each of the resistors 16 and 18 and an end of a corresponding metal semi-ring 12 or 14, to form two groups of parallel lines. In the second loop 20, a metal extension part 25 is further disposed between two ends of each of the resistors 26 and 28 and an end of a corresponding metal semi-ring 22 or 24, to form two groups of parallel lines.

The resistor 16 in the first loop 10 is located between the two opposite metal semi-rings 22 and 24 in the second loop 20, and the other resistor 18 in the first loop 10 is located outside the two opposite metal semi-rings 22 and 24 in the second loop 20. That is, the resistor 16 in the first loop 10 is located inside the second loop 20 formed by the two metal semi-rings 22 and 24 and the two resistors 26 and 28 that are connected in series, and the resistor 18 in the first loop 10 is located outside the second loop 20. This design also helps implement impedance matching.

In this embodiment, a size of the two metal semi-rings 12 and 14 in the first loop 10 is the same as a size of the two metal semi-rings 22 and 24 in the second loop 20.

In an embodiment, resistances of the two resistors 16 and 18 in the first loop 10 may be different, and resistances of the two resistors 26 and 28 in the second loop 20 may be different. In an embodiment, resistances of the two resistors 16 and 18 in the first loop 10 may be the same. In an embodiment, resistances of the two resistors 26 and 28 in the second loop 20 may be the same.

In another embodiment, the resistor 16 in the first loop 10 is located between the two opposite metal semi-rings 22 and 24 in the second loop 20, and the other resistor 18 in the first loop 10 is located between the two opposite metal semi-rings 22 and 24 in the second loop 20. That is, the resistor 16 in the first loop 10 is located inside the second loop 20 formed by the two metal semi-rings 22 and 24 and the two resistors 26 and 28 that are connected in series, and the resistor 18 in the first loop 10 is also located inside the second loop 20. In addition, the first loop 10 overlaps the second loop 20 after rotating 90 degrees by using a cross line along which the first loop 10 and the second loop 20 are orthogonal to each other as a rotation axis. This design also helps implement impedance matching.

Referring to FIG. 2, each metamaterial unit 100 further includes a first dielectric substrate 11 and a second dielectric substrate 21 that are perpendicular to each other, and the first loop 10 and the second loop 20 are disposed on the first dielectric substrate 11 and the second dielectric substrate 21 respectively. An absorption frequency band can be adjusted by adjusting a radius of the metal semi-rings 12, 14, 22, and 24 in the first loop 10 and the second loop 20 and adjusting a thickness (a thickness D2 in FIG. 4B) of the first dielectric substrate 11 and the second dielectric substrate 21 in an incident direction Din, so that the absorbing metamaterial in the disclosure not simply corresponds to a specific frequency band, but the absorption frequency band can be adjusted through parameter setting.

Electrolytes may be filled between adjacent first dielectric substrates 11 and between adjacent second dielectric substrates 21. The first loop 10 and the second loop 20 are loaded on different dielectric substrates. Therefore, after the plurality of metamaterial units 100 are periodically arranged, relatively large gaps occur between adjacent first dielectric substrates 11 and between adjacent second dielectric substrates 21. These gaps may be filled with electrolytes that have a relatively low dielectric constant (for example, the dielectric constant is less than 4).

Further referring to FIG. 2, the absorbing metamaterial in the disclosure further includes a metal backplane 200 perpendicular to the first plane and perpendicular to the second plane, that is, the metal backplane 200 is perpendicular to the first dielectric substrate 11 and the second dielectric substrate 21. The plurality of metamaterial units 100 are periodically arranged on a side surface of the metal backplane 200. The metal backplane 200 may be made of any one of types of metal such as copper, silver, and gold.

In some embodiments, the absorbing metamaterial in the disclosure may further include a skin (not shown), where the plurality of metamaterial units 100 are periodically arranged on a side surface of the skin. For example, the skin and the metal backplane 200 may be disposed opposite to each other, and the plurality of metamaterial units 100 are periodically arranged on a side surface that is of the skin and that is close to the metal backplane 200, that is, the plurality of metamaterial units 100 are located between the skin and the metal backplane 200. The skin is added, for protection, on one side of the plurality of metamaterial units 100 that are periodically arranged. This can ensure very high wave transmittance at a low frequency while ensuring wave absorption in a relatively wide frequency band.

Still with reference to FIG. 1 and FIG. 2, in an embodiment, the metal semi-ring may be a copper ring with a thickness of 20 micrometers, a dielectric constant of each of the first dielectric substrate and the second dielectric substrate is 3.1, and a loss tangent is 0.6%. In an embodiment, the metal semi-ring may be made of any one of types of metal such as gold and silver.

Figure 3:
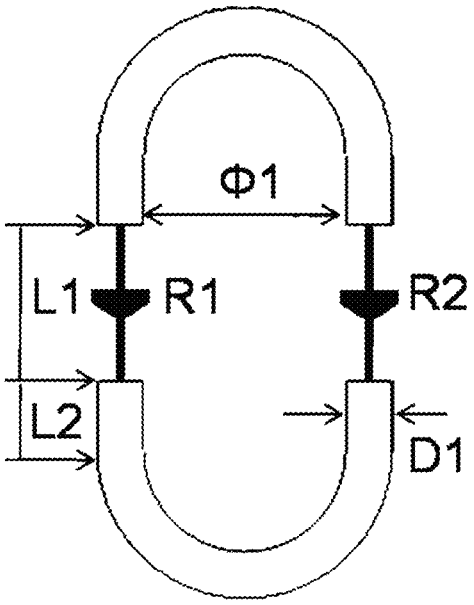
FIG. 3 is a schematic diagram of a loop of an absorbing metamaterial according to an embodiment of the disclosure.
Figure 4A:
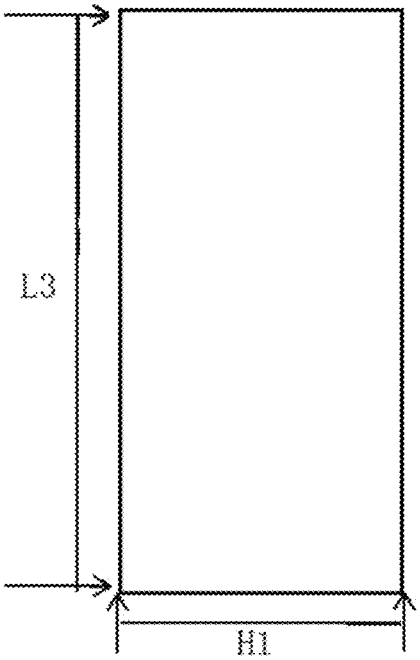
FIG. 4A is a schematic front view of a dielectric substrate of an absorbing metamaterial according to an embodiment of the disclosure.
Figure 4B:
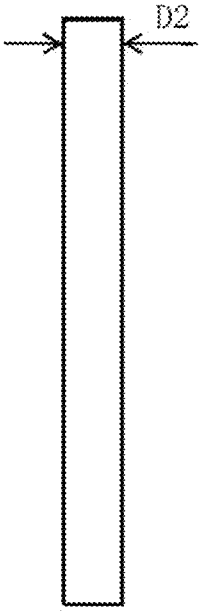
FIG. 4B is a schematic side view of a dielectric substrate of an absorbing metamaterial according to an embodiment of the disclosure.
Figure 5:
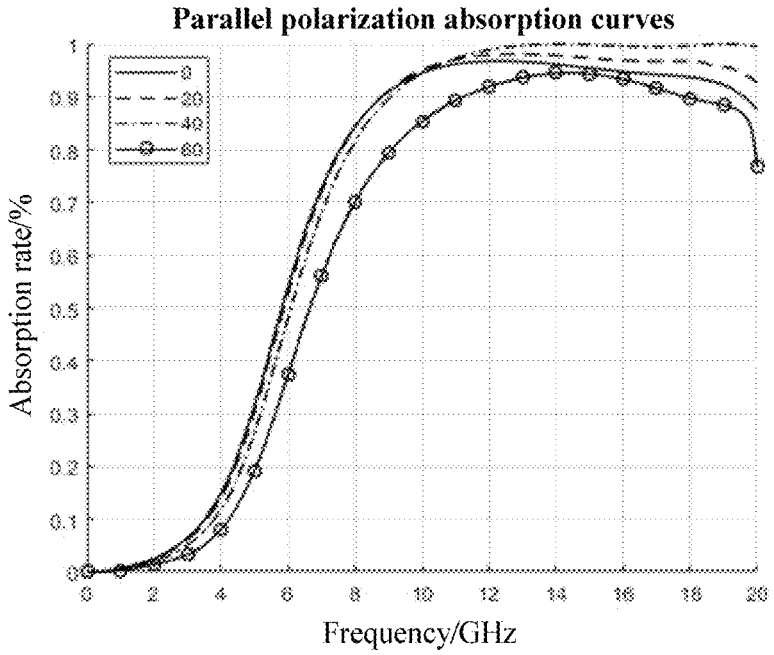
FIG. 5 is a schematic diagram of parallel polarization absorption curves of an absorbing metamaterial according to a specific embodiment of the disclosure.
Figure 6:
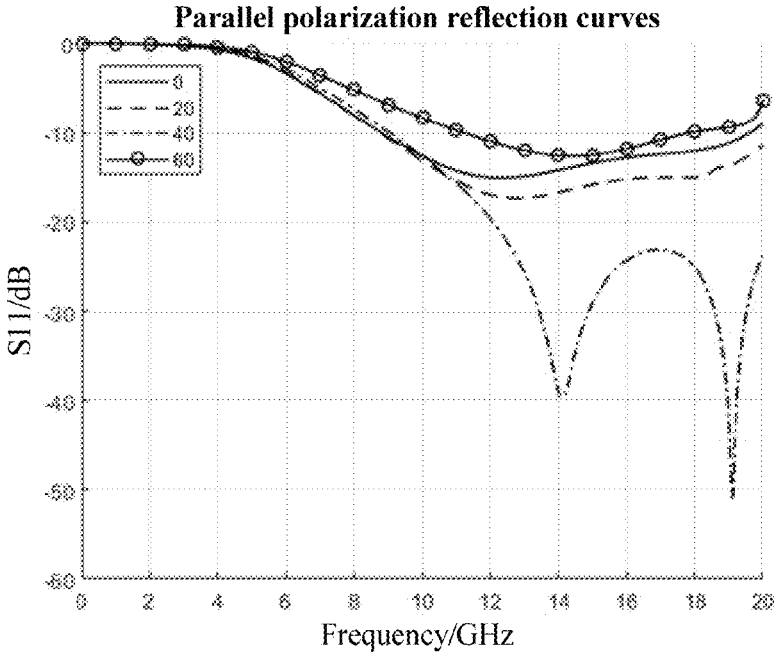
FIG. 6 is a schematic diagram of parallel polarization reflection curves of an absorbing metamaterial according to a specific embodiment of the disclosure.

With reference to FIG. 3, FIG. 4A, and FIG. 4B, in a specific embodiment, the metal semi-rings in the first loop 10 and the second loop 20 have a same size. Specifically, an inner diameter Φ1 of the metal semi-ring is equal to 2.6 mm, a width D1 of the metal semi-ring is equal to 0.6 mm, a distance L1 between two metal semi-rings and a metal extension part on a same plane (that is, in a same loop) is equal to 2 mm, and a length L2 of the metal extension part is equal to 0.9 mm. A length L3 of each of the first dielectric substrate 11 and the second dielectric substrate 21 is equal to 8 mm, and a thickness D2 of each is equal to 0.8 mm, and a width H1 of each is equal to 7 mm A resistance R1 of one resistor (for example, the resistor 16 or 26) in the first loop 10 or the second loop 20 is equal to 500Ω, and a resistance R2 of the other resistor (for example, the resistor 18 or 28) is equal to 150Ω.

Figure 7:
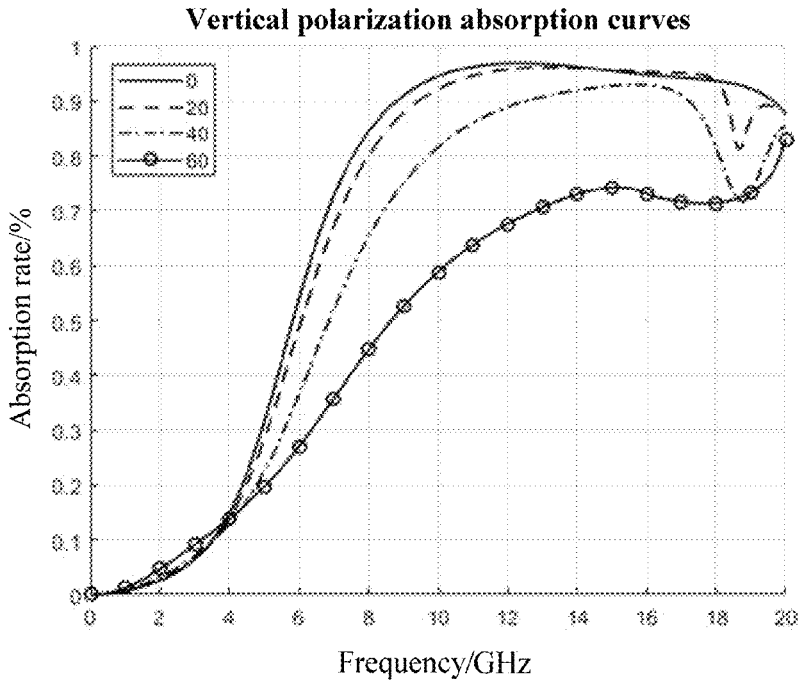
FIG. 7 is a schematic diagram of vertical polarization absorption curves of an absorbing metamaterial according to a specific embodiment of the disclosure.
Figure 8:
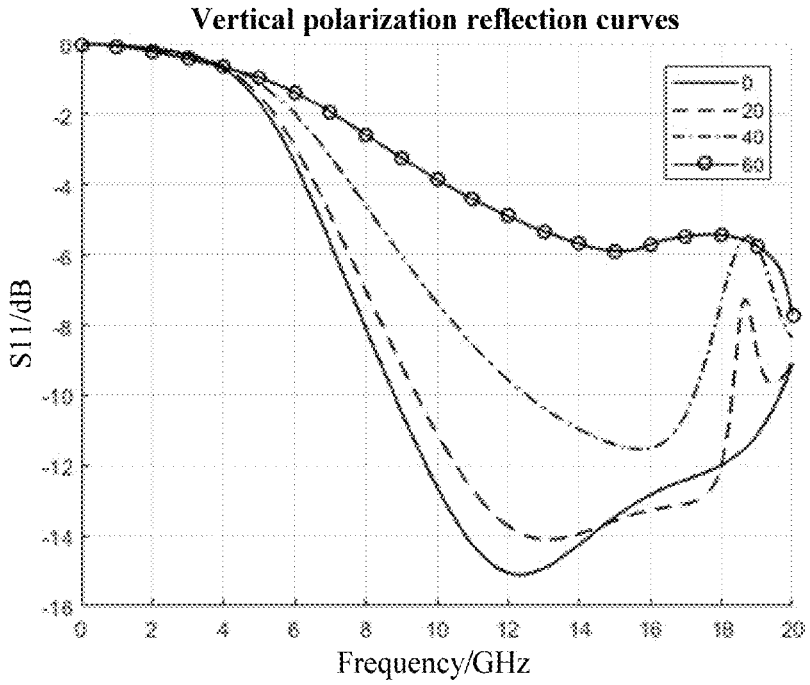
FIG. 8 is a schematic diagram of vertical polarization reflection curves of an absorbing metamaterial according to a specific embodiment of the disclosure.

FIG. 5 to FIG. 8 show simulation results of the embodiments shown in FIG. 3, FIG. 4A, and FIG. 4B. It can be learned from the simulation results that, referring to FIG. 5 and FIG. 6, in TE polarization, an absorption rate of above 70% is basically achieved in an X band (8-12 GHz) to a Ku band (12-18 GHz) within a range of 0°-60°, and an absorption rate in the Ku band is above 90%. Referring to FIG. 7 and FIG. 8, in TM polarization, an absorption rate of above 70% is basically achieved in X-Ku bands within a range of 0°-40°, and an absorption rate of above 70% is basically achieved in the Ku band within a range of 0°-60°. It should be noted that this embodiment is merely an example. An wave absorption range can be freely adjusted by adjusting parameters such as the size of the metal semi-ring, the thickness and the width of the dielectric substrate, and the resistance of the resistor. In this way, the wave absorption range can cover currently common electromagnetic frequency bands.

The absorbing metamaterial in the disclosure may be applied to a radome, and can ensure that performance of an antenna protected by the radome is basically unaffected within an operating frequency band and that out-of-band electromagnetic waves cannot enter the radome. The absorbing metamaterial in the disclosure may also be applied to the communications field, to provide a new manner for implementing functions such as using an independent channel for a single element of an antenna array.

The foregoing are merely preferred embodiments of the disclosure, but are not intended to limit the disclosure. Any modification, equivalent replacement, or improvement made within the spirit and principle of the disclosure shall fall within the protection scope of the disclosure.

What is claimed:

1. An absorbing metamaterial, comprising a plurality of metamaterial units that are periodically arranged, wherein the metamaterial unit comprises:

a first loop disposed on a first plane; and a second loop disposed on a second plane, wherein the first plane is perpendicular to the second plane, so that the first loop and the second loop are orthogonal;

each of the first loop and the second loop comprises:

two metal semi-rings that are spaced from each other and whose openings are opposite to each other; and two resistors, wherein two ends of each resistor are respectively connected to two ends that are of the two metal semi-rings and that are located on a same side and opposite to each other.

2. The absorbing metamaterial as claimed in claim 1, wherein the metamaterial unit further comprises a first dielectric substrate and a second dielectric substrate that are perpendicular to each other, and the first loop and the second loop are disposed on the first dielectric substrate and the second dielectric substrate respectively.

3. The absorbing metamaterial as claimed in claim 1, wherein a metal extension part is further disposed between two ends of each resistor and an end of a corresponding metal semi-ring.

4. The absorbing metamaterial as claimed in claim 1, wherein one resistor in the first loop is located between two opposite metal semi-rings in the second loop, and the other resistor in the first loop is located outside the two opposite metal semi-rings in the second loop.

5. The absorbing metamaterial as claimed in claim 1, wherein resistances of the two resistors in each of the first loop and the second loop are different.

6. The absorbing metamaterial as claimed in claim 1, wherein a size of two metal semi-rings in the first loop is the same as a size of two metal semi-rings in the second loop.

7. The absorbing metamaterial as claimed in claim 2, wherein electrolytes are filled between adjacent first dielectric substrates and between adjacent second dielectric substrates.

8. The absorbing metamaterial as claimed in claim 1, wherein the absorbing metamaterial further comprises:

a metal backplane perpendicular to the first plane and perpendicular to the second plane, wherein the plurality of metamaterial units are periodically arranged on a side surface of the metal backplane.

9. The absorbing metamaterial as claimed in claim 1, wherein the absorbing metamaterial further comprises:

a skin, wherein the plurality of metamaterial units are periodically arranged on a side surface of the skin.

* * * * *